United States Patent [19]

Pollard-Smith

[11] Patent Number: 4,794,877

[45] Date of Patent: Jan. 3, 1989

[54] INDICATOR DEVICE

[76] Inventor: Marjorie Pollard-Smith, 3180 N. Lake Shore Dr., Apt. #15H, Chicago, Ill. 60657

[21] Appl. No.: 104,250

[22] Filed: Oct. 5, 1987

[51] Int. Cl.[4] ..... G09F 9/00

[52] U.S. Cl. ..... 116/323; 116/321; 40/491

[58] Field of Search ..... 40/488–491, 40/324; 116/222, 225, 281, 283, 306, 307, 321–324, DIG. 3

[56] References Cited

U.S. PATENT DOCUMENTS

| | | | |
|---|---|---|---|
| 490,164 | 1/1893 | Ready | 40/491 |
| 503,389 | 8/1893 | Sheppman | 40/488 |
| 2,853,045 | 9/1958 | Thomas | 116/324 |
| 4,654,990 | 4/1987 | Suters | 40/491 |
| 4,703,712 | 11/1987 | Christman | 116/324 |

*Primary Examiner*—Steven L. Stephan
*Assistant Examiner*—W. Morris Worth
*Attorney, Agent, or Firm*—Hill, Van Santen, Steadman & Simpson

[57] ABSTRACT

An indicator device for use for example by a waitress which indicates by the position of a movable member, the type of coffee used by customers at a table. In one position, the indicator indicates that two or more customers are using regular coffee. In another position, the indicator indicates that two or more customers are using decaffinated coffee and in a third position, the indicator indicates that at least one customer is using regular coffee and the other customer is using decaf coffee. This indicator provides a convenient way to indicate at all times what kind of coffee is being utilized at a particular table.

1 Claim, 1 Drawing Sheet

INDICATOR DEVICE

BACKGROUND OF THE INVENTION

1. Field of the Invention

This invention relates in general to indicator devices and in particular to a novel device for indicating the types of coffee or other substances being used at a table by customers.

2. Description of the Prior Art

At the present time when a server at a restaurant is serving customers, it is necessary to ask each of the customers if they like coffee and, if so, what kind of coffee they prefer, decaffinated or regular coffee. After initially serving the customers, the waiter generally gives them a refill later in the meal and it is difficult to remember which type of coffee each customer prefers and it is normally necessary for him to ask again whether they prefer decaffinated or regular coffee.

The following U.S. Patents disclose various indicator devices: U.S. Pat. Nos. 1,919,321, 4,189,143, 4,654,990, 4,656,765, 2,119,839, 1,176,928, 1,197,741, 588,254, 725,585, 876,278 and 1,000,181.

SUMMARY OF THE INVENTION

The present invention provides an indicator which can be mounted on a table or elsewhere where customers are being served which can be set to indicate whether customers are having decaffinated or regular coffee such that once the indicator has been set, the waiter immediately knows by observing the indicator what kind of coffee is required at that table.

Another object of the invention is to provide a novel indicator which records the preference of customers so as to eliminate the necessity of the waiter reasking the preference of beverages.

Other objects, features and advantages of the invention will become apparent from the following description of a certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENT

Figure 1:
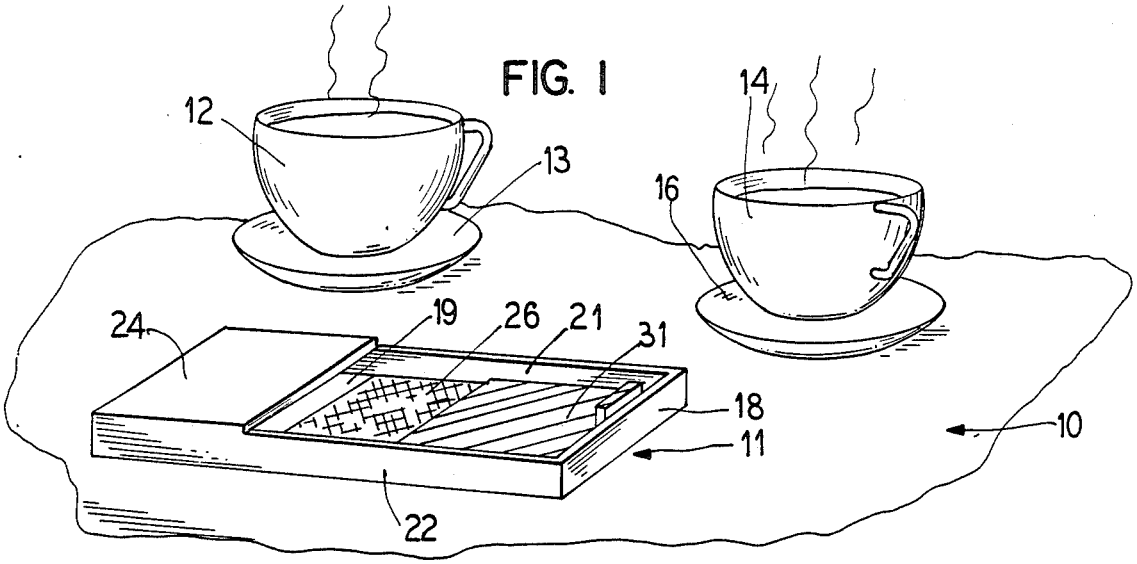
FIG. 1 is a perspective view showing the indicator of the invention for use on a serving table.

As shown in FIG. 1, a table 10 has a cup 12 and a saucer 13 and a second cup 14 and saucer 16 for serving customers. An indicator 11 of the invention is placed on the table and can be set by the server so that he will know which beverages the various customers require.

Figure 2:
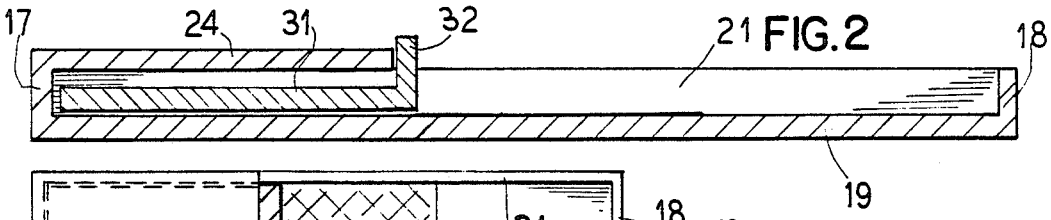
FIG. 2 is a side sectional view of the invention.
Figure 3:
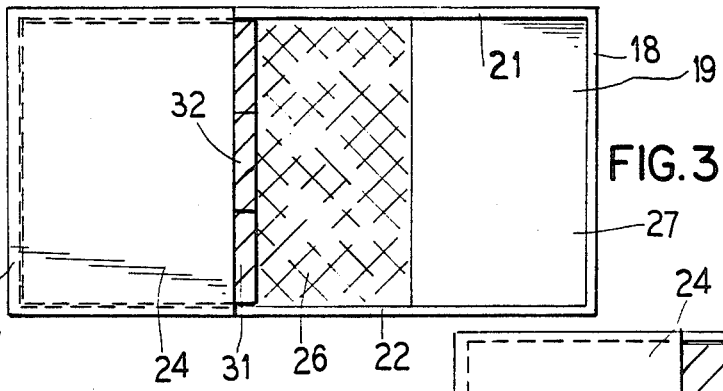
FIG. 3 is a top plan view of the invention illustrating the indicator in a first position.
Figure 4:
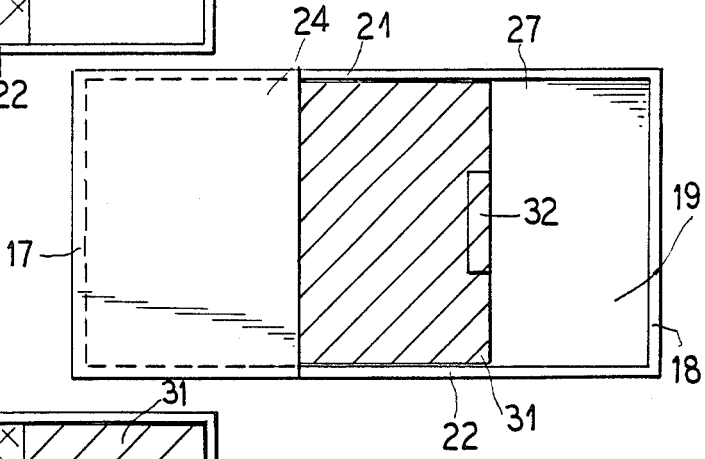
FIG. 4 is a top plan view indicating the indicator in a second position.
Figure 5:
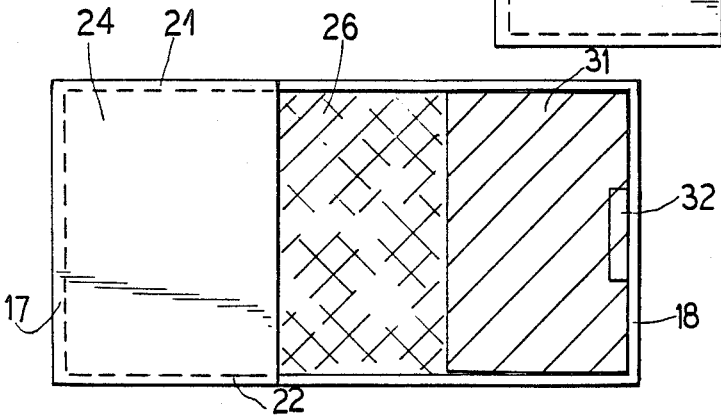
FIG. 5 is a top plan view indicating the indicator in a third position.

The indicator 11 has a bottom 19, a front wall 18, a back wall 17 and sidewalls 21 and 22. A cover member 24 extends from the backwall 17 for a distance slightly more than one-third of the length of the indicator 11. A moveable indicator 31 comprises a planar portion and a handle portion 32 which extends upwardly to allow the waiter to move it. The floor or bottom 19 of the indicator has a first region 26 adjacent the end of the top cover 24 which has a first color and has a second portion 27 which has a color different from the color of the area 26. The top of the moveable member 31 has a third color which differs from the colors of the area 26 and the area 27. FIG. 2 is a sectional view illustrating the moveable member 31 within the confines of the cover member 24. FIG. 3 also illustrates the member 31 within the confines of the cover member 24 so that the indicator areas 26 and 27 are visible. FIG. 4 illustrates a condition where the server has moved the moveable member 31 to a position such that it covers the area 26 and such that the top of the member 31 is visible and the area 27 is also visible. FIG. 5 illustrates a condition wherein the moveable 31 has been moved with the hand member 32 so that it bears against the end wall 18 so that the server can observe the area 26 and the top of the member 31 which have different colors.

In use, the waiter asks the customers whether they want decaf or regular coffee, for example, and if both customers want regular coffee this would indicate a first condition as, for example, shown in FIGS. 2 and 3. If both customers want decaf coffee, the waiter would move the indicator 31 to the position shown in FIG. 4, for example. If on the other hand, one customer wanted decaf coffee and one wanted regular coffee, the waiter would move the indicator to the position shown in FIG. 5. The indicator 11 can also be oriented such that its orientation on the table indicates to the waiter which customer wants decaf coffee and which wants regular coffee. It is to be realized, of course, that although decaf and regular coffee are used in explaining the invention that other beverages or uses can be made of the indicator and the use as a coffee indicator is just merely by way of example. In the drawings, the areas 26 and 31 are lined for color.

Although the invention has been described with respect to preferred embodiments, it is not to be so limited as changes and modifications can be made which are within the full intended scope of the invention as defined by the appended claims.

I claim as my invention:

1. An indicator for indicating beverage preferences comprising a generally flat rectangular box formed with an open bottom that extends about two-thirds of the length of said box and divided into two areas each about one third the length of said box and coated with first indicia representing a particular beverage and second indicia representing a need for two orders, a slidable cover member with a handle being mounted in said box and having a length which is about one third the length of said box and outer surface coated with a third indicia representing a different beverage, said cover member can be moved to be visible or not visible such that when said third indicia of said cover is in a first position where it is not visible said first and second indicia are visible indicating a need for two orders of said particular beverage and said cover moveable to a second position where said second and third indicia are visible indicating a need for two orders of said different beverage and first indicia is not visible and said cover member moveable to a third position where said first and third indicia are visible, indicating a need for one order of both beverages, the orientation of said indicator on a table indicates which customer wants which beverage.

* * * * *